US005810061A

United States Patent [19]

Yuyama

[11] Patent Number: 5,810,061

[45] Date of Patent: Sep. 22, 1998

[54] DRUG DISPENSER AND METHOD FOR DISPENSING DRUG

[75] Inventor: Shoji Yuyama, Ioyonaka, Japan

[73] Assignee: Kabushiki Kaisha Yuyama Seisakusho, Toyonaka, Japan

[21] Appl. No.: 618,604

[22] Filed: Mar. 20, 1996

[30] Foreign Application Priority Data

Mar. 28, 1995 [JP] Japan ..... 7-069566

[51] Int. Cl.[6] ..... B65B 43/42

[52] U.S. Cl. ..... 141/129; 141/9; 141/100; 141/103; 141/104; 141/153; 198/358; 198/349.6; 198/349.7

[58] Field of Search ..... 141/9, 100, 103, 141/104, 153, 129; 221/218, 253, 217, 219, 225, 252; 198/370.01, 370.1, 604, 465.3, 358–360, 349, 349.6, 349.7, 350

[56] References Cited

U.S. PATENT DOCUMENTS

| | | | |
|---|---|---|---|
| 2,983,392 | 5/1961 | Ebbert | 198/370.01 |
| 4,196,802 | 4/1980 | Lorentzen | 198/465.3 |
| 4,546,901 | 10/1985 | Buttarazzi | 221/10 |
| 4,870,799 | 10/1989 | Bergerioux et al. | 53/55 |
| 5,533,606 | 7/1996 | Yuyama | 198/349 |

*Primary Examiner*—David J. Walczak
*Assistant Examiner*—Timothy L. Maust
*Attorney, Agent, or Firm*—Wenderoth, Lind & Ponack, L.L.P.

[57] ABSTRACT

A drug dispenser which can dispense drugs with high efficiency. The dispenser has a plurality of drug feeders each having a drug discharging chute and capable of discharging a predetermined amount of drugs into the chute. The drug feeders are arranged in a vertical row. An elevator unit is provided to feed trays downward along the vertically arranged drug discharging chutes. Each tray is stopped at a selected tray to collect drugs stored therein. After collecting drugs, the tray is moved further down until it is placed on a conveyor. The conveyor sends the tray through an inspection station to a dispensing point.

6 Claims, 7 Drawing Sheets

DRUG DISPENSER AND METHOD FOR DISPENSING DRUG

BACKGROUND OF THE INVENTION

This invention relates to a drug dispenser which can keep drugs in the form of ampules, vials, capsules or tablets and dispense a predetermined kind of drugs in a predetermined quantity to a predetermined destination.

A hospital keeps a great many kinds of drugs so that they can administer drugs most suited for every one of the patients. It is an extremely troublesome job for pharmacists in such a hospital to locate drugs designated in a clinical chart for each patient from among numerous kinds of drugs stored on a shelf and take them out in a predetermined quantity.

To save the labor of hospital pharmacists, Examined Japanese Utility Model Publication 6-14753 proposes a drug storage/dispensing device which can automatically pick up and dispense any designated kind of drugs in the storage shelf.

More specifically, this device collects designated drugs stored in the shelf into a first tray in its picker, moves this tray onto a second tray, empties the drugs in the first tray into the second tray, and sends the second tray through an inspecting station to the discharging point.

Namely, in this arrangement, drugs collected in the first tray have to be emptied into the second tray, so that it takes a rather long time to send designated drugs to a predetermined destination. Thus, a more efficient drug dispenser has been desired.

Another problem of this device is that if drugs are stored in glass containers such as ampules, they tend to be broken when they are emptied into the second tray from the first tray.

An object of the present invention is to provide a drug dispenser which can efficiently dispense drugs without breaking them.

SUMMARY OF THE INVENTION

According to the present invention, there is provided a method of dispensing drugs comprising the steps of feeding a tray in one direction, discharging drugs stored in at least one of a plurality of drug feeders capable of discharging a predetermined amount of drugs stored therein into the tray, and feeding the tray to an inspecting station without transferring the drugs received from the at least one drug feeder to any other tray.

Another method according to the present invention comprises a method of dispensing drugs comprising the steps of arranging a plurality of drug feeders capable of discharging a predetermined amount of drugs stored therein in a vertical row, feeding a tray in the direction in which the drug feeders are arranged, discharging drugs stored in at least one of the plurality of drug feeders into the tray, and feeding the tray to an inspecting station without transferring the drugs received from the at least one drug feeder to any other tray.

The drug dispenser according to the present invention comprises a plurality of drug feeders each having a drug storage container for storing drugs and a drug discharging chute capable of discharging a predetermined amount of drugs into the chute. The drug feeders are arranged in a vertical row with their discharging chutes directed in the same direction. An elevator means is provided for moving drug-collecting trays up and down along the front ends of the discharging chutes. Also, a carrier means is provided for receiving the trays from the elevator means and feeding them through an inspecting station to a dispensing position.

The drug feeders may be provided in a plurality of vertical rows that are arranged around the feed path of the trays.

The control unit of the drug dispenser activates a predetermined one of the drug feeders to discharge a predetermined amount of drugs stored therein into a tray through the drug discharging chute. The tray is placed on the carrier means. The carrier means sends the tray to the inspecting station and then to the dispensing position.

BRIEF DESCRIPTION OF THE DRAWINGS

Other features and objects of the present invention will become apparent from the following description made with reference to the accompanying drawings, in which.

DETAILED DESCRIPTION OF THE PREFERRED EMBODIMENT

The embodiments are described with reference to the accompanying drawings.

Figure 1:
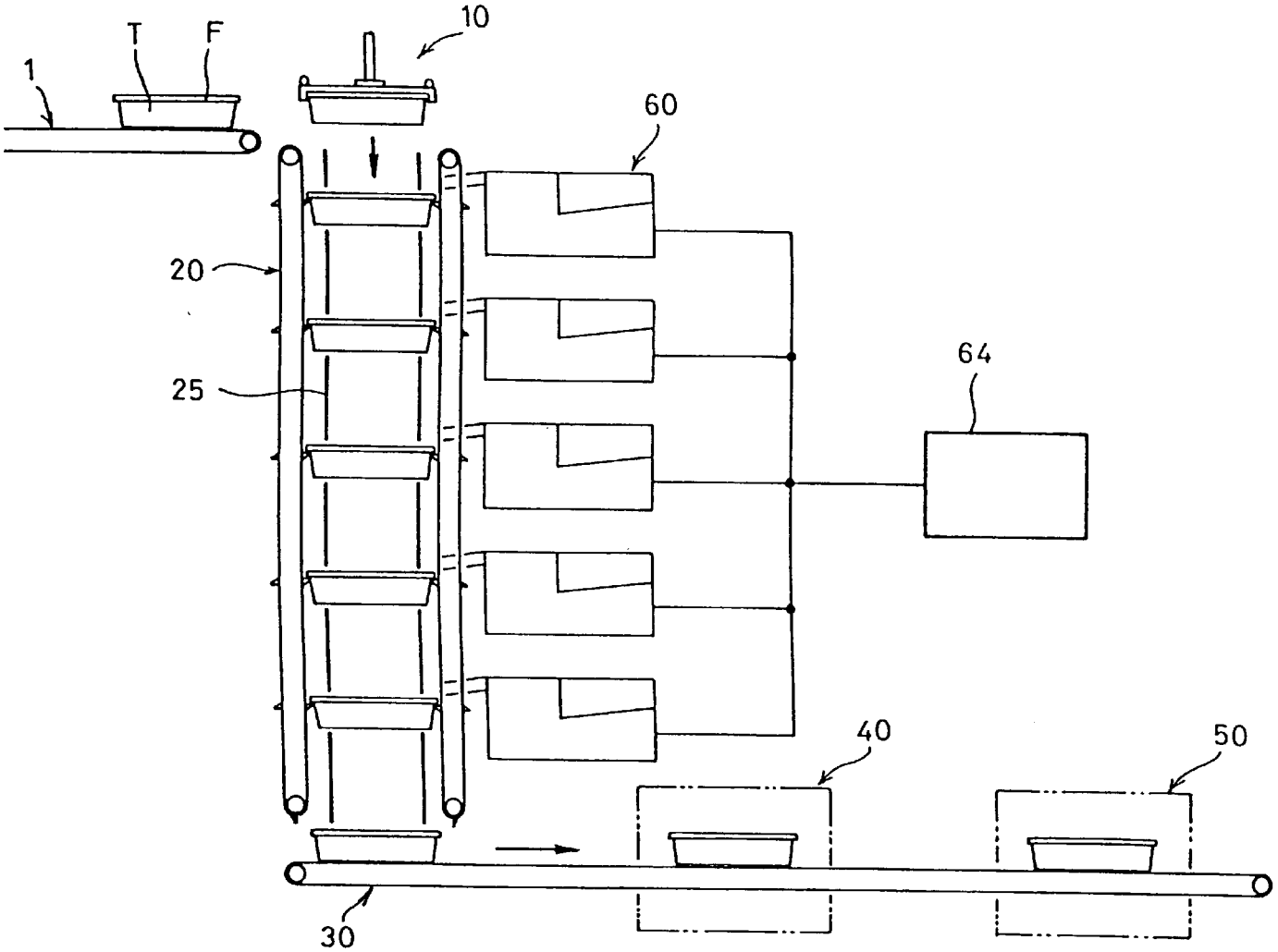
FIG. 1 is a schematic view of one embodiment of a drug dispenser according to the present invention.

Referring to FIG. 1, a tray T is fed in one direction by a first conveyor 1. The tray T is stopped at a delivery end of the conveyor 1, where it is picked up by a feed unit 10 and fed into an elevator unit 20 provided in front of the conveyor 1.

The elevator unit 20 sends the tray downward and deposits it on a feed end of a second conveyor 30.

The second conveyor 30 feeds the tray T through an inspection station 40 to a discharge area 50.

Figure 4:
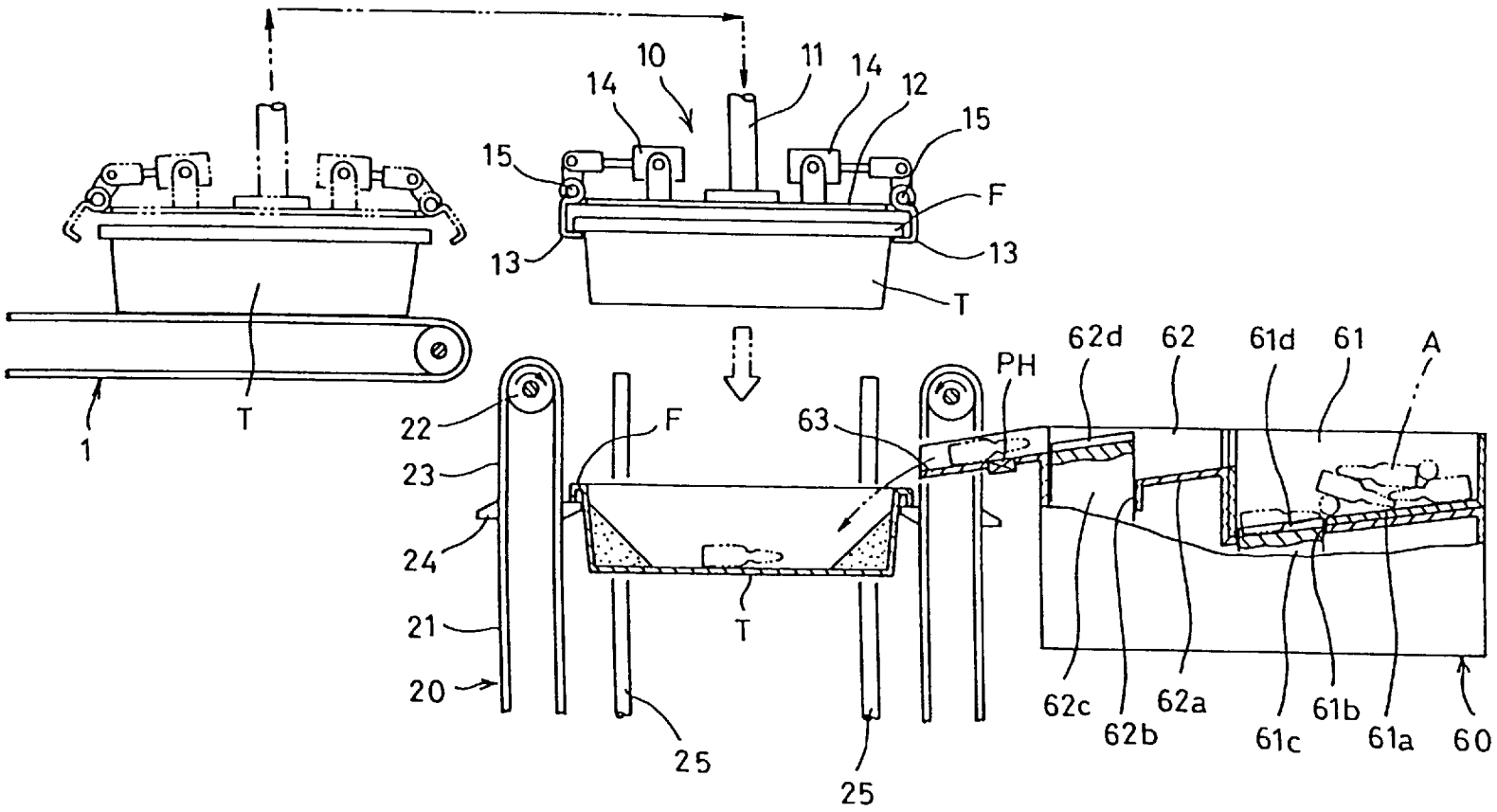
FIG. 4 is an enlarged, partially cutaway front view of an upper part of FIG. 2.

Referring to FIG. 4, the feed unit 10 comprises a vertically movable rod 11, a clamping plate 12 secured to the bottom end of the rod 11, engaging claws 13 mounted on both sides of the clamping plate 12, and cylinders 14 supported on the clamping plates 12 for pivoting the respective claws about pins 15 to open and close them.

The feed unit 10 is reciprocated horizontally between the position where the clamping plate 12 is located over the delivery end of the first conveyor 1 and the position where it is over the elevator unit 20. With the feed unit 10 moved to the position where its clamping plate 12 is located over a tray T sitting on the delivery end of the conveyor 1, the rod 11 is lowered until the clamping plate 12 abuts a top end of the tray T. Then, the engaging claws 13 are closed until they engage a flange F of the tray T provided around its top opening.

With the claws 13 in engagement with the flange F, the rod 11 is raised to lift the tray. The feed unit 10 is then moved horizontally to the position over the elevator unit 20. Once over the elevator unit, the rod 11 is lowered to a predetermined level, where the claws 13 are opened to drop the tray T into the elevator unit.

Figure 2:
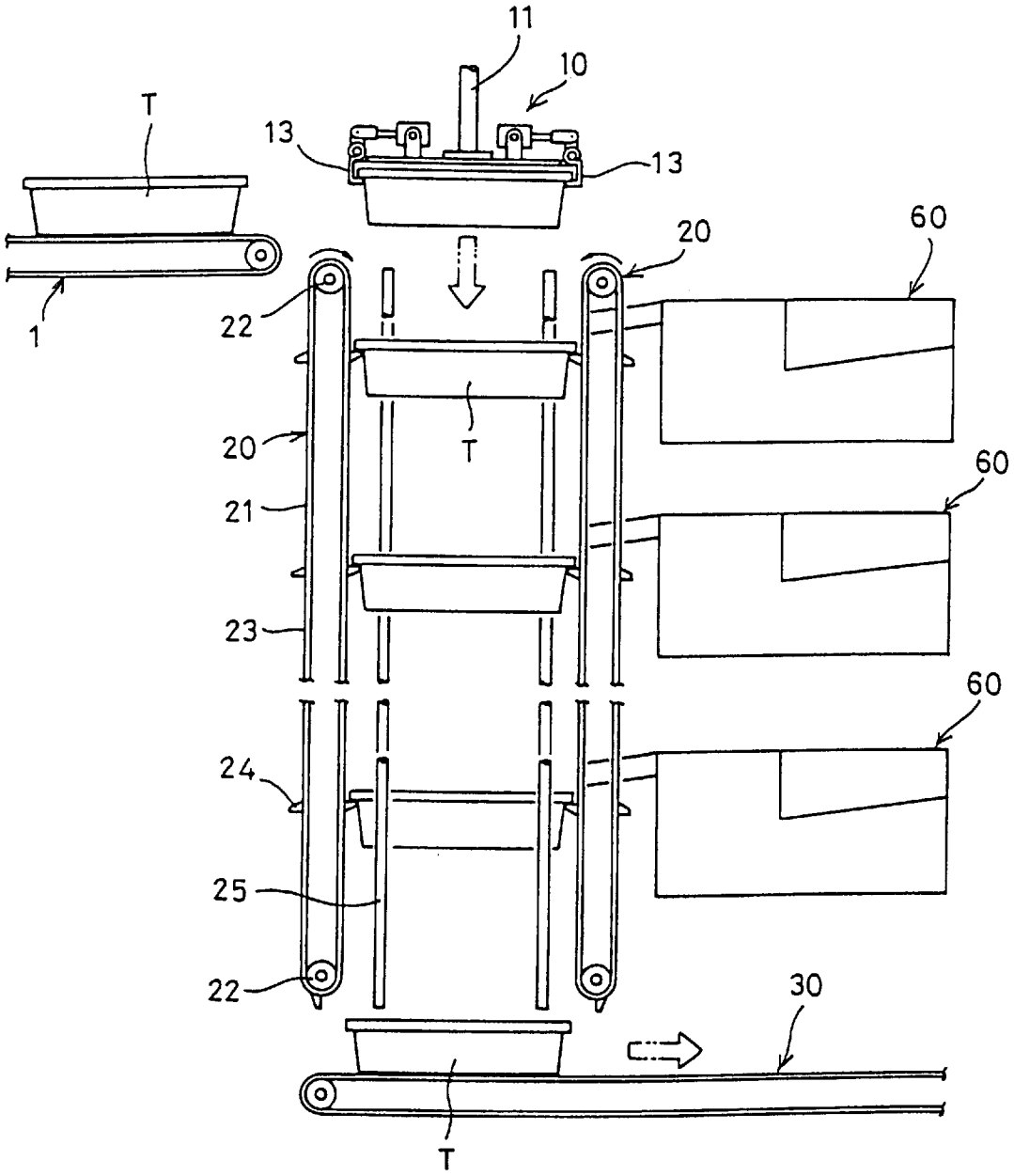
FIG. 2 is a partial, enlarged front view of the drug dispenser shown in FIG. 1.
Figure 3:
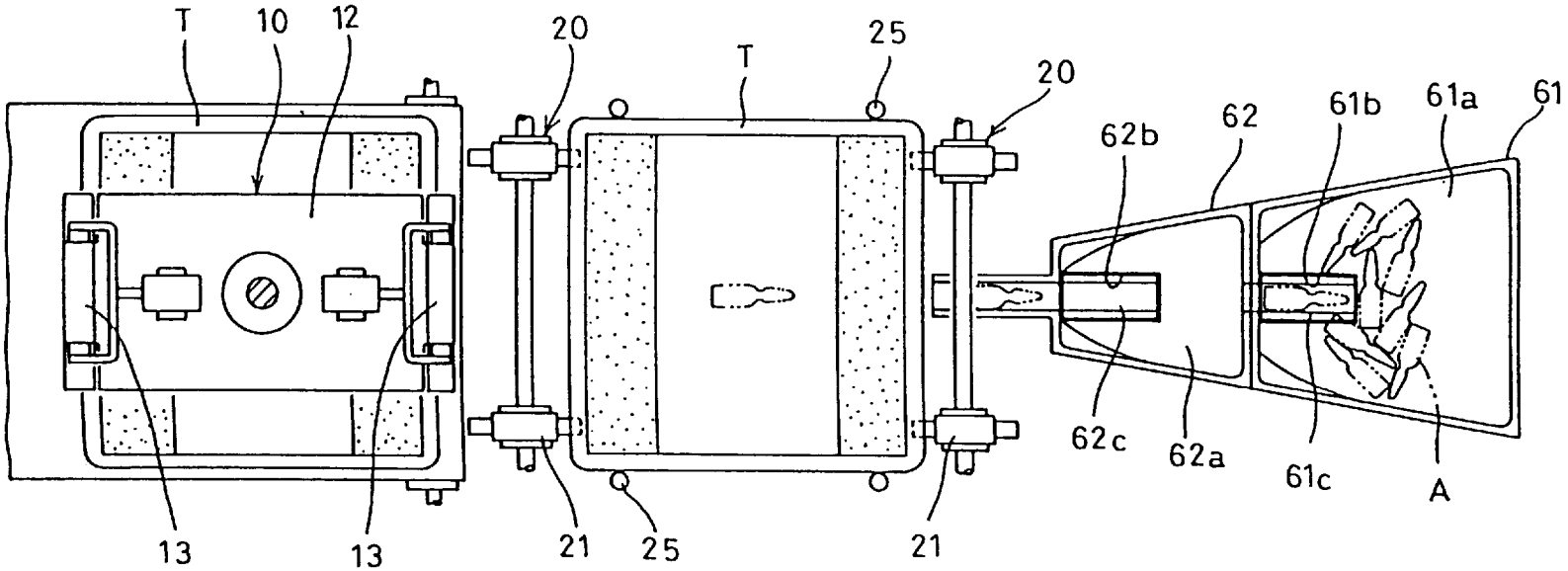
FIG. 3 is a plan view of the drug dispenser shown in FIG. 2.

As shown in FIGS. 2 and 3, the elevator unit 20 comprises a front pair and a rear pair of belt conveyors 21, each pair being spaced transversely from each other by a distance corresponding to the width of trays T. Each belt conveyor 21 comprises a top and a bottom pulley 22 and an endless belt 23 disposes around the pulleys 22. The belt 23 has catches 24 arranged longitudinally thereon at equal intervals. They are adapted to engage the flange F of each tray T when it is dropped into the elevator unit.

The elevator unit 20 sends trays T downward with their flanges F supported on the catches 24 by driving the respective belts 23 in the directions of arrows shown in FIG. 2.

A plurality of drug feeders 60 are provided one over another on one side of the feed path of trays T being fed downward by the elevator unit 20.

The drugs A stored in the drug feeders 60 may be ampules, vials, tablets or capsules. The drug feeders 60 of the embodiment are ampule dispensing feeders.

As shown in FIGS. 3 and 4, each drug feeder 60 comprises a drug container 61 and a cell 62 connected to the container 61 at the front end of the container. The drug container 61 and the cell 62 have bottom walls 61*a* and 62*a* that slope downward toward the downward feed path of trays T. Through holes 61*b* and 62*b* are formed in the bottom walls 61*a* and 62*a* at the lower ends thereof. A first and a second push-up member 61*c* and 62*c* are vertically movably inserted in the respective holes 61*b* and 62*b*. They have top support surfaces 61*d* and 62*d* sloping downward toward the front end and capable of supporting one ampule of drug A at a time.

By moving up the first push-up member 61*c*, one drug A on the support surface 61*d* is raised. When the support surface 61*d* becomes flush with the bottom wall 62*a* of the cell 62, the drug A slides down the support surface 61*d* into the cell 62.

The drug A thus fed into the cell 62 slides down the bottom wall 62*a* onto the support surface 62*d* of the second push-up member 62*c*, which is now at the lowermost position. With the drug A on the support surface 62*d*, the second push-up member 62*c* is raised to its upper limit to let the drug A slide down the support surface 62*d* into a discharge chute 63 connected to the front end of the cell 62. The drug A thus slides down in the chute 63 and is discharged from the front end of the chute.

A sensor PH for sensing the passage of drugs A is provided in the discharge chute 63. When the sensor PH detects the passage of a predetermined number of drugs A, the first and second push-up member 61*c*, 62*c* are deactivated.

Further, the drug dispenser has a control unit 64. It selects and activates a drug feeder 60 that holds drugs to be dispensed.

Before dispensing drugs A from the selected drug feeder 60, a tray T sitting on the first conveyor 1 at its delivery end is picked up by the feed unit 10, moved to the position right over the elevator unit 20, dropped into the elevator unit 20, and fed downward by the elevator unit 20 to the position where its opening is positioned directly under the front end of the discharge chute 63.

When a sensor, not shown, detects that a tray T has been moved into the predetermined position, the selected feeder 60 is activated to feed drugs A into the discharge chute 63.

The drugs discharged into the chute 63 slide down in the chute and are discharged from its front end into the tray T. When a required number of drugs A have been discharged into the tray T, the elevator unit 20 is activated to move the tray T downwardly to deposit the tray on the feed end of the second conveyor 30. The tray T is then carried to the inspecting station 40 by activating the conveyor 30.

The drugs A in the tray T are inspected by a pharmacist at the inspecting station 40. After inspection, the tray is sent to the discharge area 50 by the conveyor 30.

If it is necessary to collect a plurality of different kinds of drugs in one tray T, the drug feeders 60 that hold the plurality of kinds of drugs are activated one after another from the highest one downward. The tray is brought to these drug feeders one after another to collect drugs discharged from the respective feeders 60.

Figure 5:
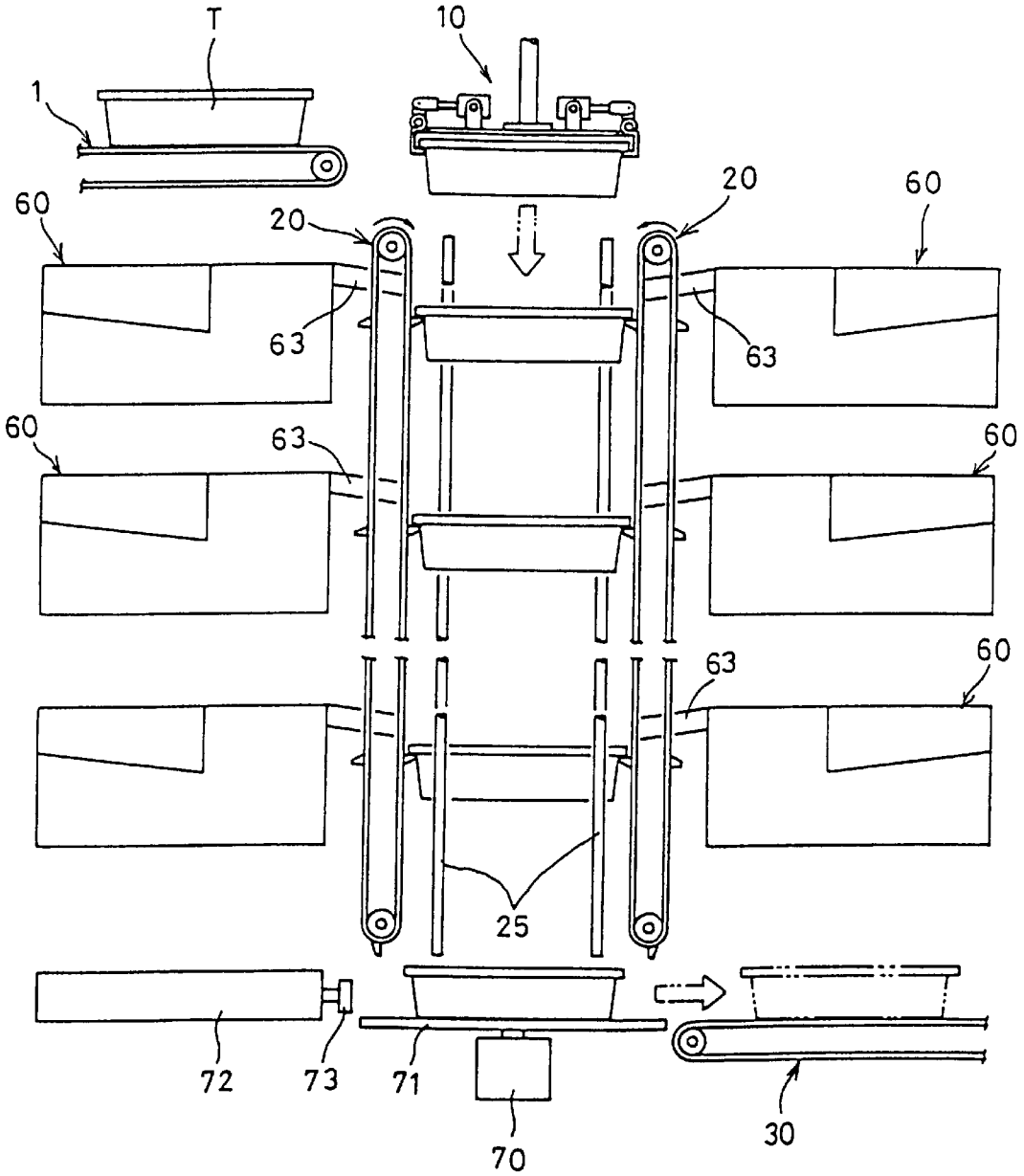
FIG. 5 is a front view of another embodiment of a drug dispenser according to the present invention.
Figure 6:
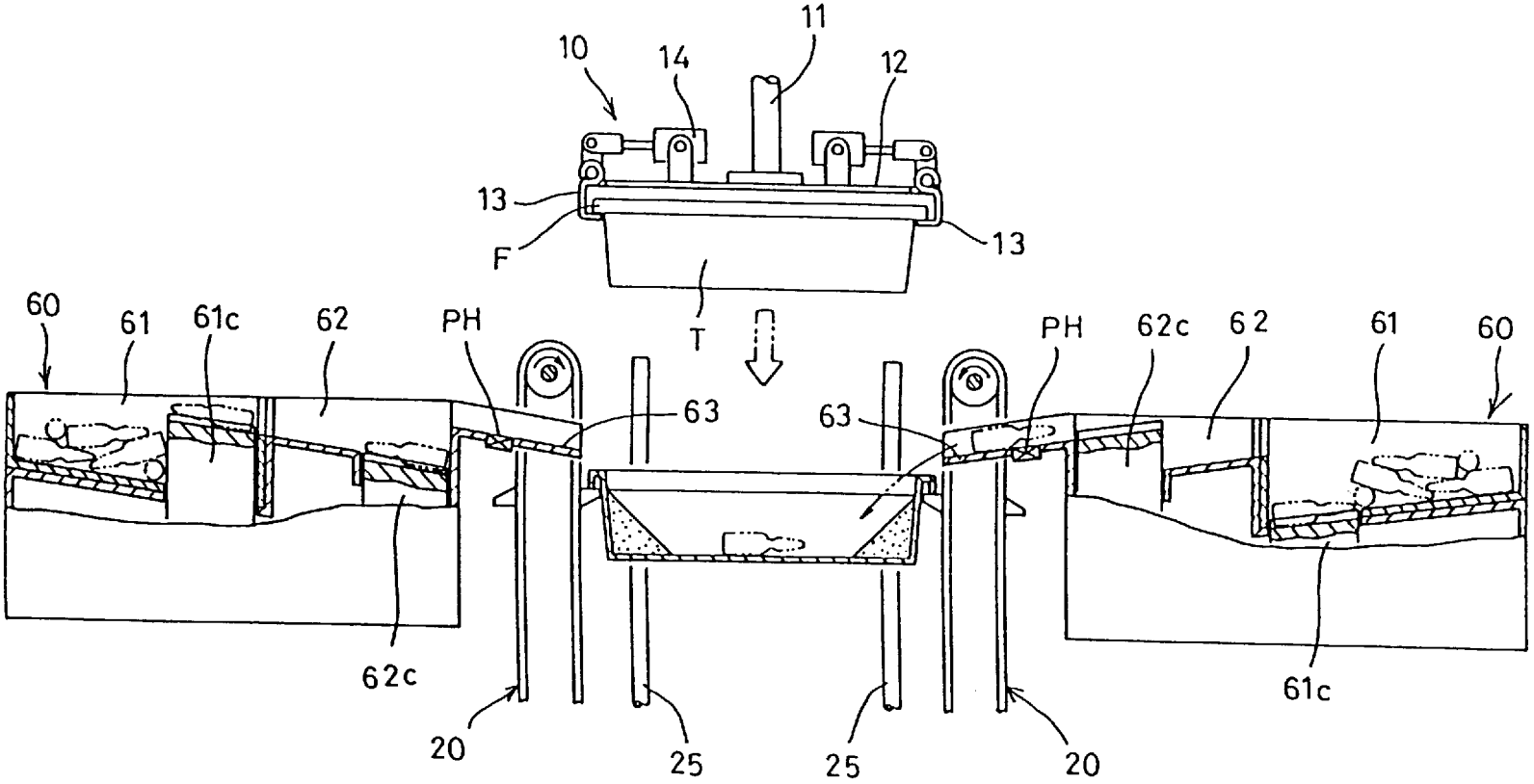
FIG. 6 is an enlarged, partially cutaway front view of an upper part of the drug dispenser shown in FIG. 5.
Figure 7:
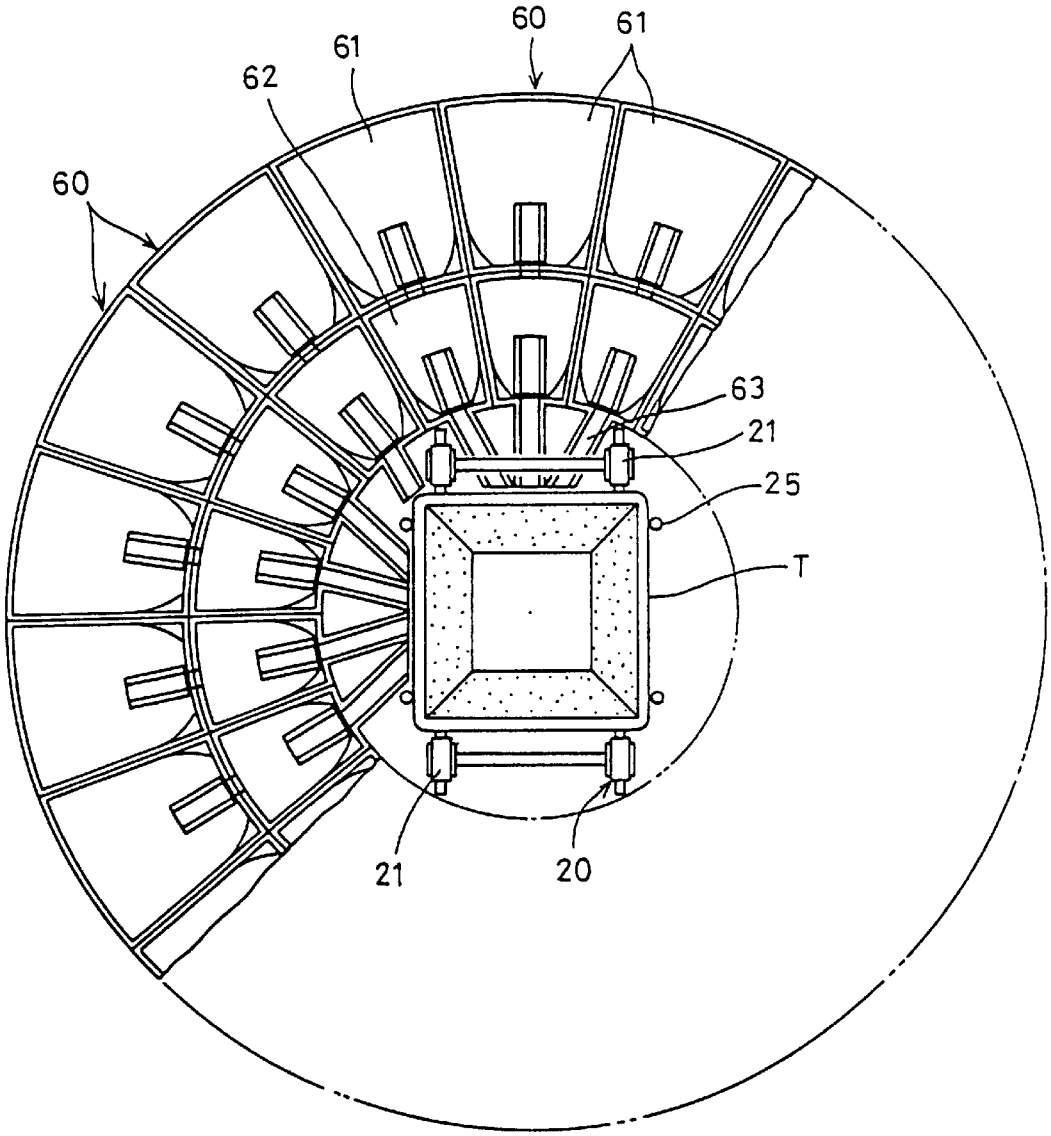
FIG. 7 is a plan view of the drug dispenser shown in FIG. 6.

FIGS. 5 to 7 show another embodiment of this invention. In this embodiment, drug feeders 60 are arranged in a plurality of vertical rows that are arranged circumferentially around the feed path of trays T being fed downward by the elevator unit 20.

Trays T are fed downward by the elevator unit 20 and deposited on a turntable 71 that is rotated by a driving unit 70. Each tray T placed on the turntable 71 is pushed out onto the second conveyor 30 by a pusher 73 reciprocated by a cylinder 72.

Once on the conveyor 30, trays T are sent through the inspecting station to the discharge area in the same manner as in the first embodiment.

In the second embodiment, the drug feeders 60, elevator unit 20 and guide rods 25 may be supported so that they can be rotated about the downward feed path of trays T while keeping their relative positions unchanged. With this arrangement, it is possible to refill the respective drug feeders 60 with drugs at a predetermined fixed circumferential position.

In this case, the rod 11 of the feed unit 10 is mounted so as to be rotatable about its axis. Each tray picked up by the feed unit is dropped into the elevator unit 20 after turning it to face a predetermined direction by turning the rod 11.

In either embodiment, trays T are fed downward by the elevator unit 20. But an elevator unit adapted to feed trays upward may be used. In this case, trays are fed from the second conveyor 30 to the elevator unit 20. The trays fed upward by the elevator unit 20 are picked up by the feed unit 10 and deposited on the first conveyor 1.

As described above, according to the present invention, drugs stored in a selected drug feeder are discharged directly into a tray. This tray is sent to the inspecting station. Namely, it is not necessary to transfer drugs discharged into one tray to another. Thus, drugs can be dispensed efficiently.

Because it is not necessary to transfer drugs from one tray to another, it is possible to feed drugs to the inspecting station without breaking them even if they are stored in glass containers such as ampules.

What is claimed is:

1. A method of dispensing drugs comprising:

feeding a plurality of trays in a first direction to a plurality of drug feeders;

moving a number of said trays simultaneously along a feed path adjacent said drug feeders and discharging drugs into said trays from at least one of said drug feeders, wherein each of said drug feeders is capable of storing drugs and discharging predetermined amounts of the drugs stored therein; and feeding each of said trays to an inspection station without transferring the drugs received in said trays from said at least one drug feeder to any other tray.

2. The method of dispensing drugs as claimed in claim 1, further comprising:

moving said trays, fed in said first direction, to an elevator; and transporting said trays in said elevator in a second direction along said drug feeders to receive drugs discharged in said discharging operation.

3. A method of dispensing drugs comprising:

arranging a plurality of drug feeders in a vertical row, wherein each of said drug feeders is capable of storing drugs and dispensing predetermined amounts of the drugs stored therein;

feeding, sequentially, a Plurality of trays in a direction along which said drug feeders are arranged in said vertical row, wherein a number of said trays are simultaneously fed along said vertical row of drug feeders so as to receive drugs therefrom;

discharging drugs into said trays from at least one of said plurality of drug feeders; and feeding each of said trays to an inspection station without transferring the drugs received in said trays from said at least one drug feeder to any other tray.

4. A drug dispenser comprising:

a plurality of drug feeders each having a drug storage container and a discharge chute, said drug feeders being arranged in a vertical row with their discharge chutes directed in the same direction, wherein each of said drug feeders are capable of dispensing predetermined amounts of drugs into said chute;

an elevator for moving drug-collecting trays along front ends of said discharge chutes; and a carrier for receiving the trays from said elevator and feeding the trays through an inspection station and then to a dispensing position.

5. The drug dispenser as claimed in claim 4, wherein said drug feeders are provided in a plurality of vertical rows arranged around a vertical travel direction of said elevator.

6. The drug dispenser as claimed in claims, further comprising:

a conveyor for moving the trays toward said elevator; and a feed unit for moving the trays from said conveyor to said elevator.

* * * * *